US007913630B2

(12) United States Patent
Creighton et al.

(10) Patent No.: US 7,913,630 B2
(45) **Date of Patent: *Mar. 29, 2011**

(54) COMBINATION KNOCKDOWN PALLET STRUCTURE AND ARTICLE CONTAINER

(75) Inventors: Thomas W. Creighton, Winnipeg (CA); Selamawit T. Desta Rogowsky, Winnipeg (CA); Edward J. Cavenagh, Winnipeg (CA)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/521,391

(22) Filed: Sep. 15, 2006

(65) Prior Publication Data

US 2007/0006782 A1 Jan. 11, 2007

Related U.S. Application Data

(63) Continuation-in-part of application No. 11/129,316, filed on May 16, 2005, now abandoned.

(51) Int. Cl.
*B65D 19/12* (2006.01)

(52) U.S. Cl. ..... 108/56.3; 108/55.1

(58) Field of Classification Search ..... 108/51.11, 108/54.1, 55.1, 55.3, 56.1, 56.3, 57.25, 57.27; 206/386, 600

See application file for complete search history.

(56) References Cited

U.S. PATENT DOCUMENTS

| | | | | |
|---|---|---|---|---|
| 154,126 | A | 8/1874 | Cotton | |
| 283,119 | A * | 8/1883 | Knapp | 108/171 |
| 981,114 | A | 1/1911 | Ridgly | |
| 2,643,080 | A | 6/1953 | Vogel | |
| 2,774,490 | A | 12/1956 | Strong | |
| 2,841,350 | A | 7/1958 | Chronister | |
| 2,928,638 | A | 3/1960 | Parker | |
| 2,930,481 | A | 3/1960 | Bebie | |
| 3,036,802 | A * | 5/1962 | Kitchell | 108/51.3 |
| 3,112,715 | A | 12/1963 | Callahan et al. | |
| 3,425,472 | A * | 2/1969 | Marino | 206/599 |
| 3,884,159 | A | 5/1975 | Faria | |
| 3,949,929 | A * | 4/1976 | Kupersmit | 206/600 |
| 4,026,219 | A | 5/1977 | Shupe et al. | |
| 4,234,973 | A | 11/1980 | Vetter et al. | |
| 4,392,437 | A | 7/1983 | Wallace | |
| 4,712,687 | A * | 12/1987 | Silcott et al. | 206/600 |
| 4,958,577 | A | 9/1990 | Demaio et al. | |
| 5,690,037 | A | 11/1997 | Hill | |
| 5,788,933 | A | 8/1998 | Peddicord | |
| 5,845,588 | A | 12/1998 | Gronnevik | |
| 5,884,566 | A | 3/1999 | Chen | |
| 5,890,437 | A * | 4/1999 | Hill | 108/51.3 |
| 6,125,771 | A | 10/2000 | Platt et al. | |
| 6,299,354 | B2 * | 10/2001 | Nickell et al. | 383/119 |
| 6,467,625 | B2 * | 10/2002 | Baker et al. | 206/599 |

(Continued)

*Primary Examiner* — Darnell M Jayne
*Assistant Examiner* — Matthew W Ing
(74) *Attorney, Agent, or Firm* — Law Offices of Steven W. Weinrieb

(57) ABSTRACT

A combination knockdown pallet structure and article container is disclosed wherein the knockdown pallet structure comprises a base panel and a pair of pockets which are secured upon undersurface portions of the base panel so as to accommodate rigid support members for accommodating the fork tines of a forklift truck. A pair of cross-brace members are pivotally secured at first end portions upon the bas member so as to be movable between first operative position and a second inoperative position in order to permit the entire pallet structure to be rolled up, folded, or otherwise knocked-down. The article container is pivotally or removably secured upon the base panel so as to provide access to the cross-brace members.

22 Claims, 3 Drawing Sheets

U.S. PATENT DOCUMENTS 6,533,121 B1 * 3/2003 Ross ..... 206/599
6,705,237 B2 3/2004 Moore, Jr. et al.
D492,835 S * 7/2004 Michaels et al. ..... D34/38
6,935,500 B1 * 8/2005 Schnaars ..... 206/386
6,973,882 B2 12/2005 Baechle et al.
7,096,797 B2 8/2006 Sharpe et al.

* cited by examiner

COMBINATION KNOCKDOWN PALLET STRUCTURE AND ARTICLE CONTAINER

CROSS REFERENCE TO RELATED PATENT APPLICATION

This patent application is a Continuation-in-Part of U.S. patent application Ser. No. 11/129,316 which is entitled KNOCKDOWN PALLET STRUCTURE, AND METHOD OF ERECTING AND KNOCKING DOWN THE SAME and which was filed on May 16, 2005 now abandoned in the name of Thomas W. Creighton et al.

FIELD OF THE INVENTION

The present invention relates generally to pallet structures for supporting packages, articles, products, palletized loads, bales, or the like, and more particularly to a new and improved combination knock-down pallet structure and article container which is either fixedly or removably attached thereto, wherein the pallet structure comprises a base panel which is fabricated from a suitable woven plastic material, wherein a pair of laterally or transversely spaced, longitudinally extending pockets or straps are secured upon undersurface portions of the base panel so as to accommodate rigid support members for accommodating or housing the fork tines of a forklift truck when the pallet structure is to be lifted and transported, wherein a pair of semi-rigid cross-brace members are respectively pivotally secured at first end portions thereof upon the pallet structure so as to be movable between a first operative assembled or erected position, at which the pair of semi-rigid cross-brace members will be disposed in a longitudinally spaced, transversely or laterally oriented position or mode such that second opposite end portions of the pair of longitudinally spaced, laterally or transversely oriented semi-rigid members will be fixedly secured within pocket members formed upon the pallet structure so as to thereby effectively span the lateral or transverse distance defined between the laterally or transversely spaced, longitudinally extending rigid support members and thereby provide lateral or transverse support to the pallet structure within the regions defined between the transversely or laterally spaced, longitudinally extending rigid support members, and a second knocked-down position at which the pair of semi-rigid cross-brace members will have their second opposite end portions removed from the pocket members so as to be disposed in a non-secured state upon the pallet structure at which the pair of semi-rigid cross-brace members can be disposed in a transversely or laterally spaced, longitudinally oriented position or mode parallel to and atop the laterally or transversely spaced, longitudinally extending rigid support members in order to permit the entire pallet structure, disposed in its knocked-down state or mode, to be rolled up or folded for compact storage and transportation purposes, and wherein an article container is either fixedly or removably secured upon the base panel.

BACKGROUND OF THE INVENTION

Conventional or prior art pallet structures are commonly seen and used within commercial warehouses and distribution centers, home appliance retail stores, and many other large commercial or industrial facilities, in order to support and transport large-sized packages, bales, articles, products, palletized loads, or the like. Such conventional or prior art pallet structures, however, comprise rigid structures which are commonly fabricated from wood or plastic materials, which are quite dense and heavy, and therefore, such conventional or prior art pallet structures comprise a considerable amount of weight. Accordingly, in view of the fact that shipping costs are based upon the weight of the items being shipped, the costs involved in shipping or transporting the pallet structures from their manufacturing plants to distribution centers or end use facilities can be quite substantial. In addition, since such conventional or prior art pallet structures comprise rigid, substantially planar structures, they cannot be, and are not designed to be, readily knocked-down or disassembled so as to be rendered compact for transportation and storage purposes. Therefore, these various factors render the conventional or prior art pallet structures costly to fabricate, costly to transport due to their relatively large amount of weight, and costly to transport and store due to the fact that such planar pallet structures do not comprise knockdown structures which would otherwise facilitate the compact arrangement and storage of the same.

Still yet further, one type of article, or set of articles, that is normally adapted or desired to be transported by means of pallet structures comprises animal hides. The hides are usually processed or treated within a suitable brine bath solution or fluid, a plurality of the hides are then disposed in folded states upon the pallet structures, and the hides then undergo a pressing operation so as to effectively remove the excess brine treatment bath solution or fluid in order to minimize the total weight of the amassed hides. Since the hides are still wet, however, the pallet structures must be fabricated from materials, which, again, are usually rigid, dense, and heavy, but in addition, cannot be susceptible to deterioration under damp or wet conditions. The pallets, with the animal hides disposed and subsequently secured thereon, can then be deposited into shipping containers for shipping and transportation purposes. While these preparatory, shipping, and transportation procedures have been viable and satisfactory in connection with, for example, full-size animal hides, or for that matter, any articles that can be readily stacked and contained upon a pallet structure, there are other articles that are not able to, in effect, be self-contained upon a pallet structure. One type of such other articles may be smaller animal body parts, such as, for example, "face plates", which, as known in the industry, comprise portions of the skin, covering the heads of the cattle, and which are used to form shoe leather products. Additional types of such other articles may comprise any fluid-like or flowable bulk materials, such as, for example, dry-bulk chemicals, powdered and palletized resins, flour, coffee beans, grains, and the like.

Accordingly, all of these types of articles need to be predisposed within suitable flexible containers such that they may then be secured, in effect, in bulk upon the pallet structures. Still further, in connection with the aforenoted objective of fabricating pallet structures which are capable of being readily knocked-down or disassembled so as to be rendered compact for transportation and storage purposes, it is also desirable to have these bulk material containers attached to such knocked-down or disassembled pallet structures so as to always ensure the fact that when the knocked-down or disassembled pallet structures are ready to be erected or assembled, the bulk material containers will already be present and will be immediately available for receiving or charging thereinto the bulk materials to be shipped and transported. These procedures would, again, not only streamline or enhance the efficiency of the shipping or transportation of the pallet structures with their cargo loads secured thereon, but would also render the arrangement or storage of such pallet structures more compact and efficient.

A need therefore exists in the art for a new and improved combination pallet structure and article container wherein the pallet structure would preferably be light in weight, would be capable of being easily erected or assembled, and conversely, would be capable of being easily knocked-down or otherwise disassembled, whereby the pallet structure would be relatively economical to fabricate, economical to ship or transport, easy and economical to store, and quick and easy to erect or assemble for use as well as quick and easy to knock-down or disassemble for shipping, transportation, and storage, and wherein further, the pallet structure would have an article container fixedly or removably mounted thereon whereby the articles to be contained therein can be immediately deposited or charged into the article container.

SUMMARY OF THE INVENTION

The foregoing and other objectives are achieved in accordance with the teachings and principles of the present invention through the provision of a new and improved combination pallet structure and article container wherein the pallet structure comprises a base panel, which is fabricated from a suitable woven plastic material, such as, for example, polypropylene, and wherein a pair of laterally or transversely spaced, longitudinally extending pockets or straps are secured upon undersurface portions of the base panel so as to accommodate a pair of laterally or transversely spaced, longitudinally extending rigid support members. The pair of laterally or transversely spaced, longitudinally extending rigid support members may comprise rigid thermoplastic tubes or pipes, fabricated, for example, from polyvinylchloride (PVC), wherein, in turn, the pair of laterally or transversely spaced, longitudinally extending rigid support members are adapted to accommodate or house the fork tines of a forklift truck when the pallet structure, along with the article container, is to be lifted and transported. A third longitudinally extending rigid support member may be secured to an undersurface portion of the base panel, and an additional support panel may be secured atop the base panel in order to impart additional support to the overall pallet structure. In addition, a pair of semi-rigid cross-brace members are respectively pivotally secured at first end portions thereof upon the pallet structure so as to be movable between first operative, assembled, and second inoperative, knocked-down, or disassembled positions. When the pair of semi-rigid cross-brace members are disposed at their first operative assembled positions, the pair of semi-rigid cross-brace members will have their second opposite end portions thereof fixedly secured with additional pocket members formed upon the pallet structure whereby the pair of semi-rigid cross-brace members will extend in laterally or transversely oriented positions so as to thereby effectively span the lateral or transverse distance defined between the laterally or transversely spaced, longitudinally extending rigid support members and thus provide lateral or transverse support to the pallet structure within the regions defined between the transversely or laterally spaced, longitudinally extending rigid support members.

Conversely, when the pair of semi-rigid cross-brace members are disposed at their second inoperative, knocked-down or disassembled positions, the second opposite end portions of the pair of semi-rigid cross-brace members will have been removed from the pocket members whereby the pair of semi-rigid cross-brace members will now be disposed in laterally or transversely spaced, longitudinally extending modes so as to be able to be disposed parallel to and atop the laterally or transversely spaced, longitudinally extending rigid support members in order to permit the entire pallet structure to be rolled up or folded for compact storage and transportation purposes. In this manner, the new and improved pallet structure is capable of being easily erected or assembled, and conversely, is capable of being easily knocked-down or disassembled so as to facilitate shipping and transportation, storage, and on-site use of the same. The article container may be fabricated from a suitable woven plastic material which is similar to that from which the base panel is fabricated, such as, for example, polypropylene, and one edge portion of the article container may be fixedly secured to one edge portion of the base panel by any suitable means, such as, for example, by stitching the woven fabric materials together. Alternatively, the article container may be removably attached to the base panel by means of loop and strap fastener members. The top of the article container may either be topless so as to effectively remain open, depending upon the particular articles to be shipped and transported within the article container, or alternatively, the top of the article container may be closed by means of a top or ceiling member within which there is provided a fill spout for depositing or charging bulk materials into the article container. Still yet further, the top portion of the article container may be provided with drawstring or flap type closure members.

BRIEF DESCRIPTION OF THE DRAWINGS

Various other features and attendant advantages of the present invention will be more fully appreciated from the following detailed description when considered in connection with the accompanying drawing, wherein.

DETAILED DESCRIPTION OF THE PREFERRED EMBODIMENT

Figure 1:
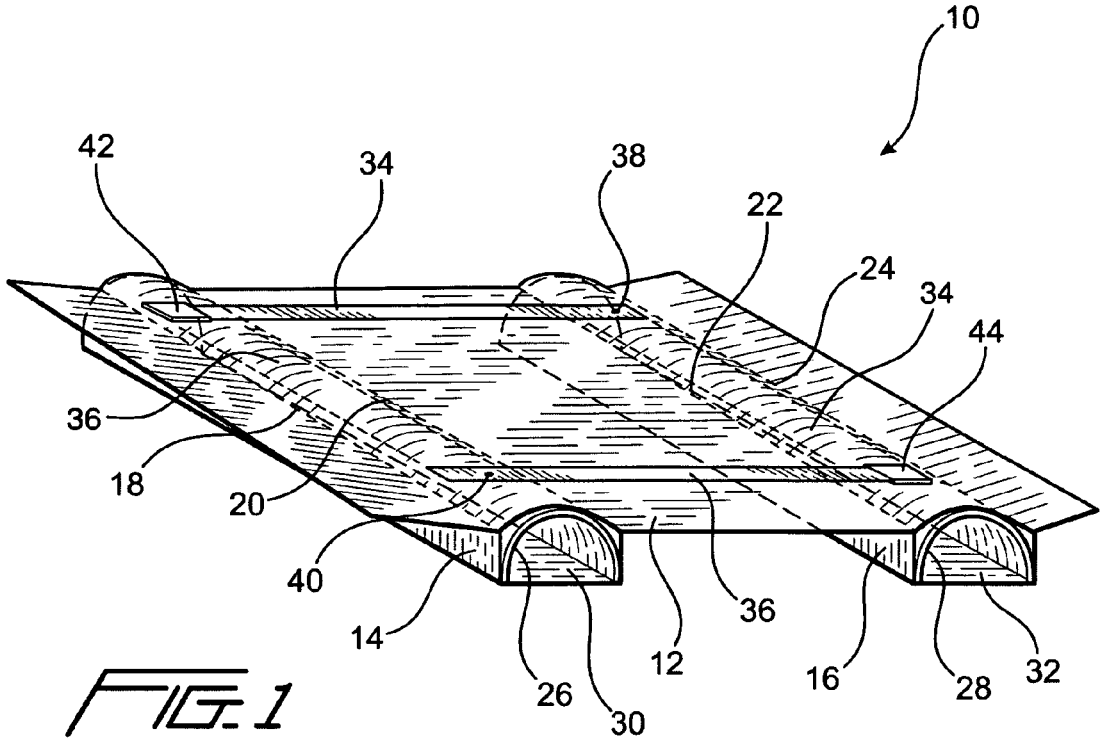
FIG. 1 is a perspective view of a first embodiment of a new and improved pallet structure which has been constructed in accordance with the principles and teachings of the present invention, which is light in weight, which is capable of being easily erected or assembled, and which, conversely is capable being easily knocked-down or disassembled so as to be folded or rolled up for shipping, transportation, or storage of the same.

Referring now to the drawings, and more particularly to FIG. 1 thereof, a first embodiment of a new and improved pallet structure, which has been constructed in accordance with the principles and teachings of the present invention, is disclosed and is generally indicated by the reference character 10. More particularly, the new and improved pallet structure 10 is seen to comprise a relatively flexible base panel 12 which is preferably fabricated as a woven fabric from a suitable plastic material, such as, for example, polypropylene. The relatively flexible base panel 12 will have a length dimension of approximately forty-two inches (42.00"), and a width dimension of approximately forty-two inches (42.00"), and in this manner, the base panel 12 effectively serves as the floor member of the pallet structure 10 for supporting the package, bale, article, product, palletized load, or the like, thereon. It is noted that while the particularly or specifically noted dimensions may be varied so as to suit particular or specific needs characteristic of, for example, particular or specific packages, bales, articles, products, palletized loads, or the like, the pallet structure base or floor member 12 having the noted dimensions will be proper so as to adequately support most packages, bales, articles, products, palletized loads, or the like, thereon.

A pair of laterally or transversely spaced, longitudinally extending pocket members 14,16, comprising, in effect, three-sided structures which are open at, at least, the front end portions thereof, are respectively secured to undersurface portions of the base panel 12 as a result of, for example, stitching the upper free end portions of the side wall portions of the laterally or transversely spaced, longitudinally extending pocket members 14,16 to the undersurface portions of the base panel 12 as denoted by means of the stitching loci 18,20 and 22,24. The pair of transversely or laterally spaced, longitudinally extending pocket members 14, 16 may be fabricated from a material which is the same as, or similar to and compatible with, the material used to fabricate the base panel 12 so as to be capable of being readily secured to the undersurface portions of the base panel 12 by means of the aforenoted stitching as denoted by means of the loci 18,20 and 22,24. As a result of the foregoing structural assembly, the pair of laterally or transversely spaced, longitudinally extending, three-sided pocket members 14,16 are able to accommodate a pair of laterally or transversely spaced, longitudinally extending rigid support members 26,28. Each one of the pair of laterally or transversely spaced, longitudinally extending rigid support members 26,28 has a substantially semi-circular cross-sectional configuration, although other cross-sectional configurations are of course possible, and each one of the pair of transversely or laterally spaced, longitudinally extending rigid support members 26,28 may comprise a rigid, thermoplastic tube or pipe which may be fabricated, for example, from polyvinylchloride (PVC).

The diametrical extent of each one of the pair of laterally or transversely spaced, longitudinally extending rigid support members 26,28 may be on the order of five inches (5.00"), while the longitudinal extent of each one of the pair of laterally or transversely spaced, longitudinally extending rigid support members 26,28 may be on the order of forty-two inches (42.00"), and it can therefore be appreciated that by respectively incorporating or inserting the pair of laterally or transversely spaced, longitudinally extending rigid support members 26,28 into the pair of transversely or laterally spaced, longitudinally extending pocket members 14, 16, the pair of laterally or transversely spaced, longitudinally extending rigid support members 26,28 effectively define passageways 30,32 into which, for example, the fork tines of a forklift truck can be inserted when the pallet structure 10, along with the package, bale, article, product, palletized load, or the like, disposed thereon, is to be lifted and transported. It is to be noted still further that the provision of the pair of laterally or transversely spaced, longitudinally extending pocket members 14,16 at fixed positions upon the pallet structure base panel 12, wherein the pair of laterally or transversely spaced, longitudinally extending pocket members 14,16 extend parallel with respect to each other, effectively serves to cause the pair of transversely or laterally spaced, longitudinally extending rigid support members 26,28 to be oriented and maintained in a parallel mode or state with respect to each other, when the pallet structure 10 is fully erected or assembled as will become more apparent hereinafter, so as to, in turn, ensure the fact that the fork tines of the forklift truck can in fact be readily inserted into the pair of transversely or laterally spaced, longitudinally extending rigid support members 26,28 when in fact the pallet structure 10, along with the package, bale, article, product, palletized load, or the like, disposed thereon, is to be lifted and transported.

With reference still being made to FIG. 1, and in accordance with additional principles and teachings of the present invention, another unique feature, characteristic of the new and improved pallet structure 10 of the present invention, resides in the fact that a pair of semi-rigid cross-brace members 34,36 are provided upon the upper surface portion of the pallet structure base panel 12. The pair of semi-rigid cross-brace members 34,36 may be fabricated from suitable plastic materials, such as, for example, ABS or polyvinylchloride (PVC). The pair of semi-rigid cross-brace members 34,36 are respectively pivotally secured at first diametrically opposite end portions thereof upon the upper surface portion of the pallet structure base panel 12 by means of suitable screw or bolt fasteners 38,40, wherein the screw or bolt fasteners 38,40 are adapted to be passed through the first diametrically opposite end portions of the pair of semi-rigid cross-brace members 34,36, through the upper surface portions of the pallet structure base panel 12, and into the upper crested portions of the pair of laterally or transversely spaced, longitudinally extending rigid support members 26,28. In this manner, the pair of semi-rigid cross-brace members 34,36 are movable between first operative or assembled positions, as illustrated, so as to be disposed in a longitudinally spaced, laterally oriented parallel mode with respect to each other, and second inoperative, knocked-down, or disassembled positions, not illustrated for clarity purposes, at which the pair of semi-rigid cross-brace members 34,36 will be disposed in a laterally or transversely spaced, longitudinally oriented parallel mode with respect to each other.

Accordingly, when the pair of semi-rigid cross-brace members 34,36 are disposed at their second, knocked-down, or disassembled positions, the pair of semi-rigid cross-brace members 34,36 will be disposed atop the pair of transversely or laterally spaced, longitudinally extending rigid support members 26,28 so as to also be disposed parallel to the pair of laterally or transversely spaced, longitudinally extending rigid support members 26,28. More particularly, each one of the semi-rigid cross-brace members 34,36 will have a width dimension of approximately two inches (2.00"), a length dimension of approximately thirty-six inches (36.00"), and a thickness dimension of approximately one quarter inch (0.025"). It is further seen that when the pair of semi-rigid cross-brace members 34,36 are disposed at their first operative, erected, or assembled positions so as to be disposed in their longitudinally spaced, laterally or transversely oriented parallel mode with respect to each other, the pair of longitudinally spaced, laterally or transversely oriented semi-rigid cross-brace members 34,36 will have their second opposite end portions thereof fixedly secured within additional pocket members 42,44 which are secured atop the upper surface portion of the pallet structure base panel 12.

Conversely, when the pair of semi-rigid cross-brace members 34,36 are to be disposed at their second inoperative, knocked-down, or disassembled positions, as illustrated by means of the dotted line positions, at which the pair of semi-rigid cross-brace members 34,36 will be disposed in the transversely or laterally spaced, longitudinally oriented parallel mode with respect to each other, the second opposite end portions of the pair of semi-rigid cross-brace members 34,36 will have been withdrawn from the pocket members 42,44. It is to be appreciated still further that when the pair of semi-rigid cross-brace members 34,36 are disposed at either one of their aforenoted first operative, erected, or assembled positions, at which the pair of semi-rigid cross brace members 34,36 will be disposed in their longitudinally spaced, laterally or transversely oriented parallel mode with respect to each other, or at their second inoperative, disassembled, or knocked-down positions at which the pair of semi-rigid cross-brace members 34,36 will be disposed in their laterally or transversely spaced, longitudinally oriented parallel mode with respect to each other, the pair of semi-rigid cross-brace members 34,36 serve or facilitate a variety of functions.

More particularly, when the pair of semi-rigid cross-brace members 34,36 are disposed at their aforenoted first operative, erected, or assembled positions at which the pair of semi-rigid cross-brace members 34,36 will be disposed in their longitudinally spaced, laterally or transversely oriented parallel mode with respect to each other, the pair of longitudinally spaced, laterally or transversely oriented semi-rigid cross-brace members 34,36 will, firstly, dispose and maintain the laterally or transversely spaced, longitudinally extending rigid support members 26,28 at their predeterminedly desired laterally or transversely spaced, longitudinally extending positions so as to be ready for the insertion thereinto of the fork tines of a forklift truck when, for example, the pallet structure 10, along with the package, bale, article, product, palletized load, or the like, disposed thereon, is to be lifted and transported. Secondly, the pair of longitudinally spaced, laterally or transversely oriented semi-rigid cross-brace members 34,36 will effectively provide lateral or transverse support, that is, the pair of longitudinally spaced, laterally or transversely oriented semi-rigid cross-brace members 34,36 will provide a predetermined amount of rigidity, to the pallet structure 10 as a result of extending between the laterally or transversely spaced, longitudinally extending rigid support members 26,28, such that the pallet structure 10 does not exhibit excessive sagging when a particular package, bale, article, product, palletized load, or the like, is disposed thereon. Conversely, when the pair of semi-rigid cross-brace members 34,36 are disposed at their second inoperative, disassembled or knocked-down positions, the second opposite end portions of the pair of semi-rigid cross-brace members 34,36 will have been removed from the pocket members 42,44 and the pair of semi-rigid cross-brace members will be able to be pivoted around the pivotal axes defined by means of the fastener screws or bolts 38,40 so as to now be disposed in their laterally or transversely spaced, longitudinally extending mode wherein the pair of laterally or transversely spaced, longitudinally extending semi-rigid cross-brace members 34,36 will now be disposed parallel to and atop the laterally or transversely spaced, longitudinally extending rigid support members 26, 28. In this manner, the entire pallet structure 10 is able to be rolled up or folded over upon itself for compact storage and transportation purposes.

While the mode of operation comprising the use of the new and improved pallet structure 10, constructed in accordance with the principles and teachings of the present invention, are submitted to be readily able to be appreciated, a brief description of the same will now be provided. Assuming that the new and improved pallet structure 10 has been previously knocked-down or disassembled, whereby the same would be rolled or folded up upon itself with respect to, for example, the longitudinal axes defined by means of the laterally or transversely spaced, longitudinally extending rigid support members 26,28, the pallet structure 10 is unrolled or unfolded so as to attain a substantially flat or planar disposition as illustrated within FIG. 1. The pair of semi-rigid cross-brace members 34,36, which have been disposed at their laterally or transversely spaced, longitudinally extending positions parallel to and atop the transversely or laterally spaced, longitudinally extending rigid support members 26,28, are now pivotally rotated around their first end portions which are pivotally secured to the pallet structure 10 by means of fasteners 38,40, such that the second end portions of the pair of semi-rigid cross-brace members 34,36 can now be incorporated within the pocket members 42,44. This completes the erection or assembly of the pallet structure 10, whereby the same is now ready to be used in conjunction with the support, hoisting or lifting, and transportation of packages, articles, products, palletized loads, bales, or the like. Conversely, when the particular service or operation of the pallet structure 10 has been completed, the pallet structure 10 may be simply knocked-down or disassembled by removing the second end portions of the pair of semi-rigid cross-brace members 34,36 from the pocket members 42,44, rotating the pair of semi-rigid cross-brace members 34,36 around the axes defined by means of the fasteners 38,40 so as to be disposed parallel to and atop the laterally or transversely spaced, longitudinally extending rigid support members 26,28, and rolling up the pallet structure 10 around a longitudinally oriented axis disposed parallel to the longitudinally extending rigid support members 26,28.

Figure 2:
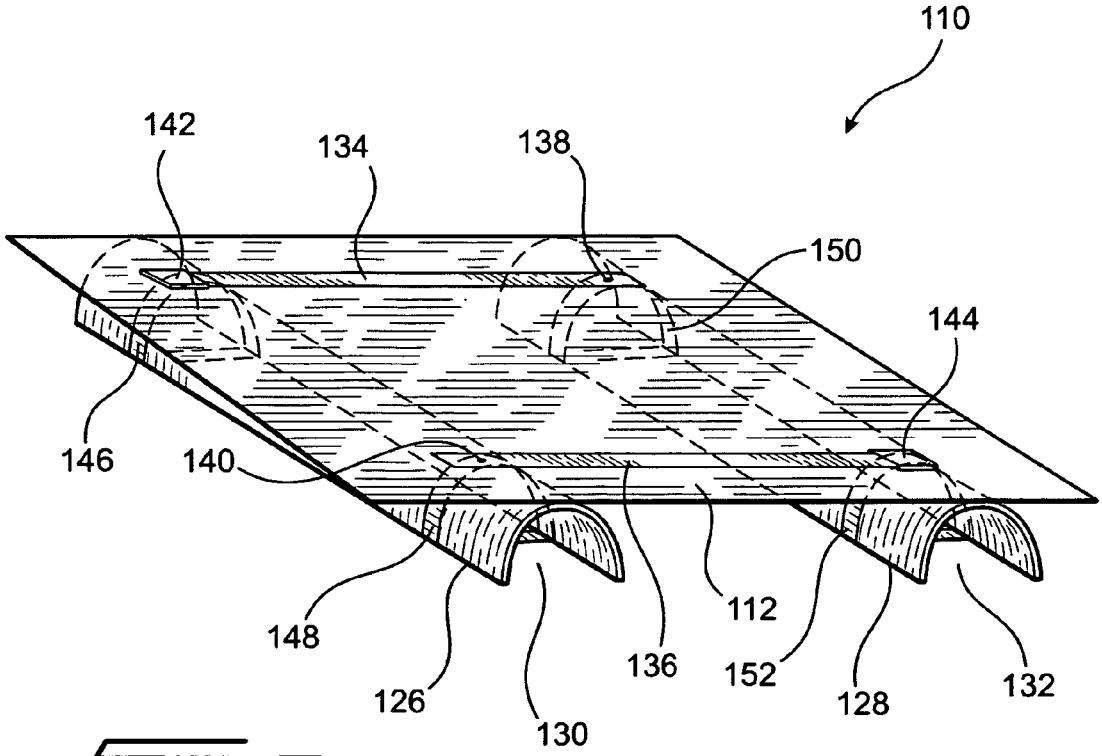
FIG. 2 is a perspective view of a second embodiment of a new and improved pallet structure which has also been constructed in accordance with the principles and teachings of the present invention, wherein the pallet structure is similar to the pallet structure as disclosed within FIG. 1, however, in lieu of the pair of laterally or transversely spaced, longitudinally extending pocket members secured to the undersurface portions of the base panel for respectively accommodating the pair of laterally or transversely spaced, longitudinally extending rigid support members, a pair of longitudinally spaced strapping members are secured to undersurface portions of the base panel for respectively accommodating each one of the pair of laterally or transversely spaced, longitudinally extending rigid support members.

With reference now being made to FIG. 2, a second embodiment of a pallet structure, constructed in accordance with the principles and teachings of the present invention, is disclosed and generally indicated by the reference character 110. It is to be noted that the second embodiment pallet structure 110 is similar in structure to the first embodiment pallet structure 10 as disclosed within FIG. 1, except as will be noted hereinafter, and therefore the detailed description of the second embodiment pallet structure 110 will be confined to the structural differences existing between the first and second embodiment pallet structures 10, 110 as respectively disclosed within FIGS. 1 and 2. It is further noted that the various structural components of the second embodiment pallet structure 110, which correspond to those structural components of the first embodiment pallet structure 10, will be designated by similar reference characters except that they will be within the 100 series.

More particularly, then, it is seen that the only significant difference between the first and second embodiment pallet structures 10,110 resides in the fact that the pair of laterally or transversely spaced, longitudinally extending pocket members 14,16, for accommodating the laterally or transversely spaced, longitudinally extending rigid support members 26,28, have effectively been eliminated, and in lieu thereof, first and second pairs of longitudinally spaced straps 146,148, and 150,152, are respectively secured to undersurface portions of the pallet structure base panel 112 for respectively accommodating each one of the transversely or laterally spaced, longitudinally extending rigid support members 126, 128. It can of course be appreciated that by utilizing the first and second pairs of longitudinally spaced, semi-circular straps 146,148 and 150,152, in lieu of the pair of laterally or transversely spaced, longitudinally extending pocket members 14,16, upon the undersurface portions of the pallet structure base panel 112, the same operational attributes, as provided or demonstrated by means of the pair of laterally or transversely spaced, longitudinally extending pocket members 14,16, that is, the housing and accommodating of the pair of transversely or laterally spaced, longitudinally extending rigid support members 126,128, and the maintaining the pair of transversely or laterally spaced, longitudinally extending rigid support members 126,128 parallel with respect to each other so as to, in turn, ensure the fact that the fork tines of the forklift truck can in fact be readily inserted into the pair of transversely or laterally spaced, longitudinally extending rigid support members 126, 128 when the pallet structure 110, along with the package, bale, article, product, palletized load, or the like, disposed thereon, is to be lifted and transported, can likewise be achieved. It is to be noted that while the straps 146,148, and 150,152 appear to have semi-circular configurations, the straps 146,148, and 150,152 are actually originally circular in cross-section but conform to the semi-circular cross-sectional configurations of the rigid support members 126,128.

Figure 3:
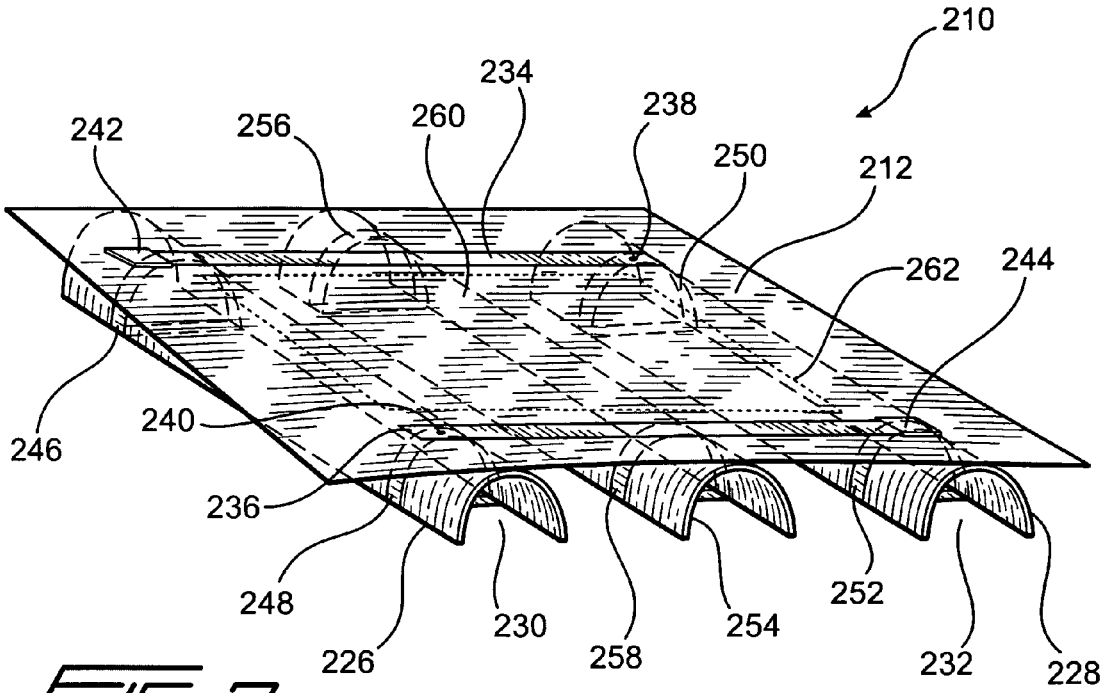
FIG. 3 is a perspective view of a third embodiment of a new and improved pallet structure which has also been constructed in accordance with the principles and teachings of the present invention, wherein the pallet structure is similar to the pallet structure as disclosed within FIG. 2, however, in lieu of the provision of only the two laterally or transversely spaced, longitudinally extending rigid support members secured to the undersurface portions of the base panel, three laterally or transversely spaced, longitudinally extending rigid support members are utilized in order to impart additional support to the overall pallet structure in connection with substantially heavy palletized loads.

With reference now being made to FIG. 3, a third embodiment of a pallet structure, constructed in accordance with the principles and teachings of the present invention, is disclosed and generally indicated by the reference character 210. It is to be noted that the third embodiment pallet structure 210 is similar in structure to the first and second embodiment pallet structures 10,110 as disclosed within FIGS. 1 and 2, except as will be noted hereinafter, and therefore the detailed description of the second embodiment pallet structure 210 will be confined to the structural differences existing between the first, second, and third embodiment pallet structures 10,110, 210 as respectively disclosed within FIGS. 1,2, and 3. It is further noted that the various structural components of the third embodiment pallet structure 210, which correspond to those structural components of the first and second embodiment pallet structures 10,110 will be designated by similar reference characters except that they will be within the 200 series.

More particularly, then, it is seen that the only significant differences between the third embodiment pallet structure 210, as compared to the first and second embodiment pallet structures 10,110 resides in the fact that, in addition to the use of the pair of transversely or laterally spaced, longitudinally extending rigid support members 226, 228 that are adapted to house the fork tines of the forklift vehicle when the forklift vehicle is to lift and transport the pallet structure 210, a third longitudinally extending rigid support member 254 is adapted to be secured to the undersurface portion of the base panel 212, by means of an additional pair of longitudinally spaced straps 256,258, such that the third longitudinally extending rigid support member 254 is interposed between, and extends parallel to, the pair of transversely or laterally spaced, longitudinally extending rigid support members 226, 228. While the third longitudinally extending rigid support member 254 does not interact with, or accommodate, one of the fork tines of the forklift vehicle, the additional longitudinally extending rigid support member 254 provides enhanced structural support to the overall pallet structure 210 whereby packages, articles, products, palletized loads, bales, or the like, having significant or substantial weight, can be properly and adequately supported without the pallet structure 210 exhibiting any significant sagging within the central portion thereof.

Continuing further, and in order to provide the overall pallet structure 210 with still yet additional support, another additional feature characteristic of the third embodiment pallet structure 210 resides in the provision of an auxiliary support panel 260 which is removably mounted atop the base panel 212 within a pocket 262. The auxiliary support panel 260 and the pocket 262 have a longitudinal extent which is less than the distance defined between the two semi-rigid cross-brace members 234,236 when the two semi-rigid cross-brace members 234,236 are disposed in their operative, assembled or erected positions, and the lateral or transverse extent of the pocket 262 and the auxiliary support panel 260 is such as to be less than the distance defined between the two pivot points of the fasteners 238, 240. In this manner, the provision or presence of the pocket 262, with the auxiliary support panel 260 disposed therein, does not interfere with the disposition of the semi-rigid cross-brace members 234, 236 when they are disposed at either one of the first, operative erected or assembled position, or the second, inoperative, knocked-down or disassembled position. It is of course to be appreciated that when the pallet structure 210 is disposed in its knocked-down or disassembled state, the auxiliary support panel 260 is removed from the pocket 262, whereas when the pallet structure 210 is disposed in its erected or assembled state, the auxiliary support panel 260 is inserted into the pocket 262. It is to be noted that the auxiliary support panel 260 may be fabricated from suitable stiffener materials, such as, for example, cardboard, corrugated cardboard, or a suitable plastic material, such as, for example, ABS or polyvinylchloride (PVC), and the panel may either have a solid or honeycomb structure.

Figure 5:
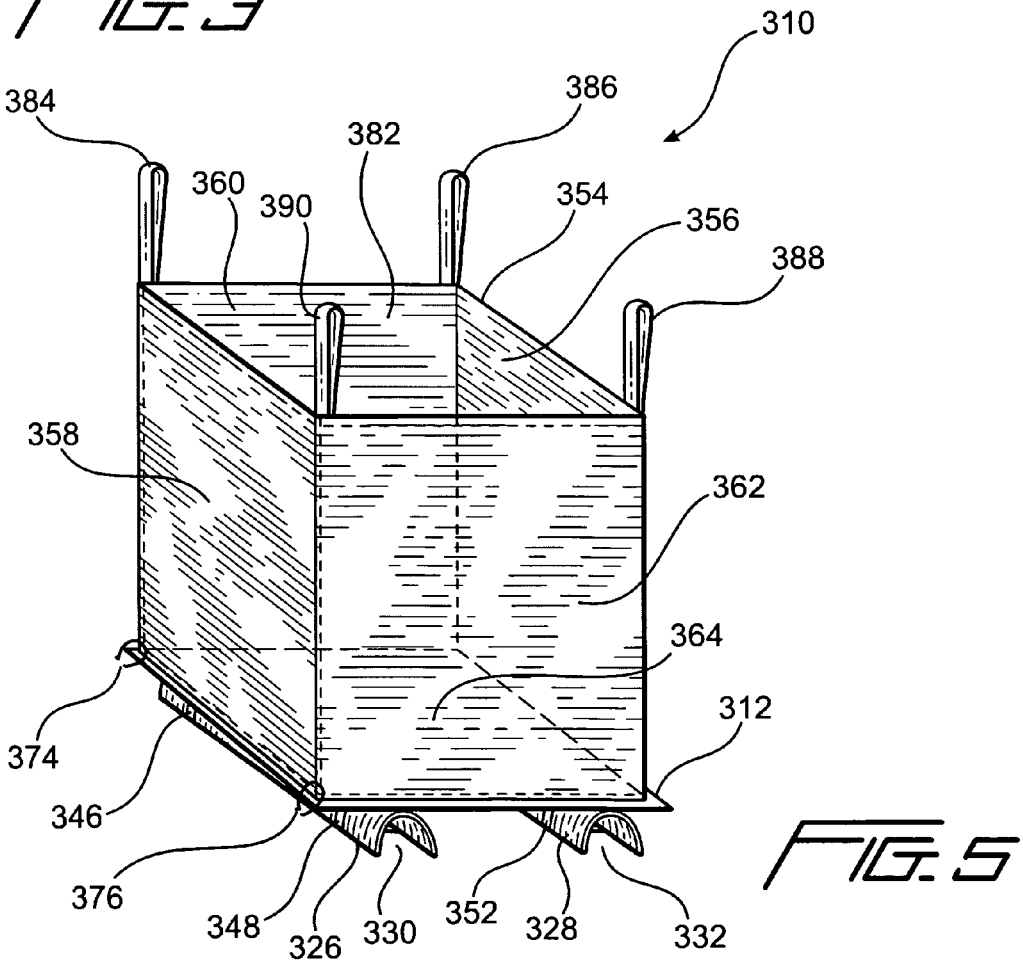
FIG. 5 is a perspective view of the new and improved combination pallet structure and article container, as disclosed within FIG. 4, wherein the opposite side edge portion of the article container is illustrated as being secured to the opposite side edge portion of the pallet structure.
Figure 4:
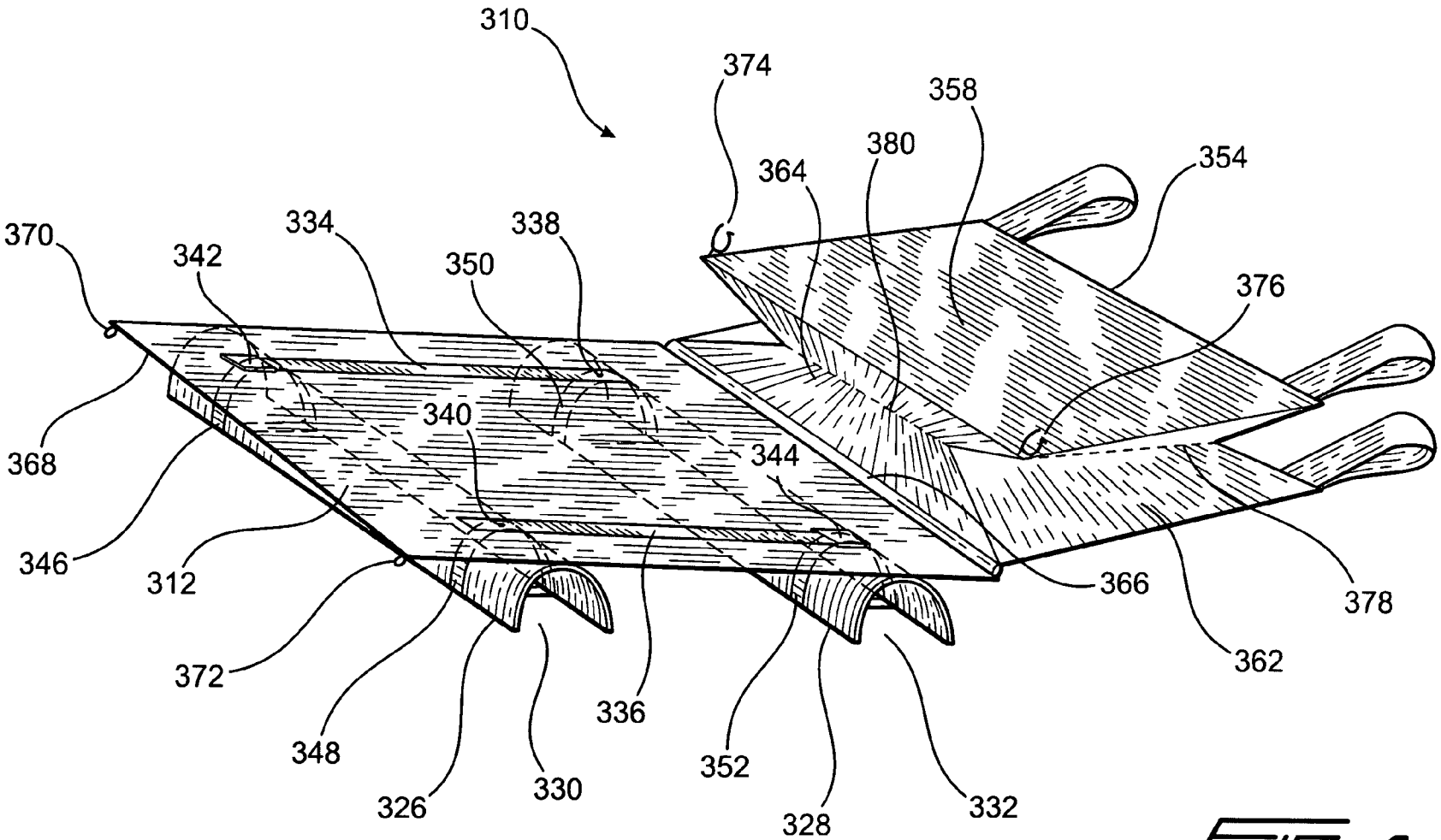
FIG. 4 is a perspective view of a new and improved combination pallet structure and article container wherein the article container is disclosed as being pivotally secured at one side edge portion thereof to one side edge portion of the pallet structure so as to enable the pallet structure to be knocked-down or disassembled from its assembled or erected state whereby the entire pallet structure and article container can be folded or rolled up for compact storage, or alternatively, the pallet structure can be assembled or erected from its knocked-down or disassembled state whereby the opposite side edge portion of the article container can then be secured to the opposite side edge portion of the pallet structure.

With reference now being made to FIGS. 4 and 5, a new and improved combination pallet structure and article container, constructed in accordance with the principles and teachings of the present invention, is disclosed and is generally indicated by the reference character 310. It is to be noted that the pallet structure, which forms an integral part of the combination pallet structure and article container 310, is substantially identical in structure to the second embodiment pallet structures 110 as disclosed within FIG. 2, except as will be specifically noted, and therefore a detailed description of the pallet structure will not be provided for brevity purposes, but to the contrary, the description will be confined to the structural differences existing between the second embodiment pallet structure 110 as disclosed within FIG. 2 and the pallet structure which forms an integral part of the combination pallet structure and article containter 310. It is further noted that the various structural components of the combination pallet structure and article container 310, which correspond to those structural components of the second embodiment pallet structure 110 will be designated by similar reference characters except that they will be within the 300 series. More particularly, it is seen, for example, that in addition to the aforenoted pallet structure per se, an article container 354 is adapted to be fixedly secured to the base panel 312 of the pallet structure. The article container 354 may be fabricated from a material which is substantially similar to that from which the base panel 312 of the pallet structure is fabricated, such as, for example, woven polypropylene, and is adapted to be expansible and compactible. Accordingly, when the article container 354 is disposed in its expanded state, it is seen that the article container 354 has a substantially rectangular parallelepiped configuration comprising a pair of oppositely disposed upstanding side walls 356,358, a pair of oppositely disposed upstanding end walls 360,362, and a bottom wall member 364. The lower side edge portion of the article container 354, which is defined between the lower edge portion of the upstanding side wall 356 and the side edge portion of the bottom wall member 364, is fixedly secured to a side edge portion of the base panel 312 by suitable means, such as, for example, by sewing or stitching the lower side edge portion of the article container 354 to the side edge portion of the base panel 312 along a locus 366 which may therefore comprise or effectively define a living hinge structure by means of which the article container 354 is pivotally secured to the side edge portion of the base panel 312.

Continuing further, the side edge portion 368 of the base panel 312, which is disposed opposite the side edge portion of the base panel 312 which is integrally connected to the lower side edge portion of the article container 354 by means of the living hinge structure defined along the locus 366, is provided with suitable fastener means, such as, for example, hook, eye, or loop structures 370,372 which are located within the corner regions of the side edge portion 368 of the base panel 312, and correspondingly, the corner regions of the lower side edge portion of the article container 354, which is disposed opposite the lower side edge portion of the article container 354 which is fixedly secured to the base panel 312 along the hinge structure 366, are provided with suitable straps or similar types of tie members 374,376 which can secure such corner regions of the lower side edge portion of the article container 354 to the hook, eye, or loop structures 370,372 disposed within the corner regions of the side edge portion 368 of the base panel 312. Accordingly, it can be appreciated that when, for example, the assembled or erected combination pallet structure and article container 310 is to be knocked-down, broken down, or disassembled, after, for example, the contents of the article container 354 have been withdrawn or discharged, the straps or ties 374,376 are disengaged from the hook, eye, or loop structures 370,372 and the article container 354 is then pivotally moved around its hinge structure 366 from its erected or assembled position, as illustrated within FIG. 5, to the position illustrated within FIG. 4.

In order to facilitate the compactibility of the article container 354, it is seen that the oppositely disposed upstanding end walls 360,362, as well as the bottom wall member 364, have fold lines or creases defined therein, as at 378,380, so as to permit the oppositely disposed upstanding end walls 360, 362 and the bottom wall member 364 to effectively be folded inwardly in a pleated manner. Subsequently, the second end portions of the pair of semi-rigid cross-brace members 334, 336 are disengaged from the pocket members 342,344 whereby the pair of semi-rigid cross-brace members 334,336 can then be pivotally moved around their pivotal axes 338,340 such that the pair of semi-rigid cross-brace members 334,336 can be respectively moved to their knocked-down or disassembled positions whereby the pair of semi-rigid cross-brace members 334,336 can be disposed atop of, and parallel to, the pair of transversely or laterally spaced, longitudinally extending rigid support members 326, 328. The entire combination pallet structure and article container 310 can then be rolled up or folded in a compact manner for storage purposes.

Conversely, when the knocked-down, disassembled, and rolled or folded combination pallet structure and article container 310 is to be erected or assembled from its rolled or folded stored state, the combination pallet structure and article container 310 is initially unfolded or unrolled, and the combination pallet structure and article container 310 is then subsequently expanded such that, for example, the article container 354 is effectively moved off to the side of the pallet structure, and the pair of longitudinally extending rigid support members 326,328 will be transversely or laterally spaced from each other. At this point in time, the pair of semi-rigid cross-brace members 334,336 are disposed atop of, and parallel to, the pair of laterally or transversely spaced, longitudinally extending rigid support members 326, 328. Therefore, the pair of semi-rigid cross-brace members 334,336 can now be pivoted around their first end portion axes 338,340 such that the second opposite end portions thereof can be inserted into the pocket members 342,344. This operation fully erects or assembles the pallet structure, and subsequently, the article container 354 can be simultaneously pivotally rotated around its hinge structure 366 and expanded such that the article container 354 can be moved and erected from its disposition or state as illustrated within FIG. 4 to its disposition or state as illustrated within FIG. 5 whereupon the article container 354 can be secured upon the pallet structure as a result of engaging the straps or ties 374,376 with the hook, eye, or loop structures 370,372.

Continuing still further, it is noted that the article container 354 has an open top region 382, and that the four upper corner regions of the article container 354 are respectively provided with closure straps, drawstrings, or the like as illustrated at 384,386,388,390 by means of which the top region 382 of the article container 354 can effectively be closed once the articles, bulk materials, or the like have been deposited within or charged into the article container 354. Means, other than the closure straps or drawstrings 384-390, for achieving closure of the top region 382 of the article container 354 can of course be utilized, and alternatively still further, the top region 382 may in fact be closed by means of an upper wall member, not shown, within which a filling or discharge spout may be provided for permitting the articles or bulk materials to be deposited or charged into the article container 354 as well as to permit the articles or bulk materials to be withdrawn or discharged from the article container 354. Still yet further, in lieu of the article container 354 being fixedly secured to the side edge portion of the base panel 312 by means of the hinge structure 366, it is contemplated that the article container 354 could be removably attached to the base panel 312 by means of hook, loop, or eye fasteners, similar to the hook, loop, or eye fasteners 370,372, being disposed at all four corner regions of the base panel 312, and in a similar manner, straps or tie members, similar to the straps or tie members 374,376, being provided upon all four lower corner regions of the article container 354. Pivotal movement of the article container 354 with respect to the pallet structure, between the positions or states illustrated within FIGS. 4 and 5 can of course be achieved by, for example, first securing the straps or tie members to the loop or eye fasteners disposed upon the side edge portion of the combination pallet and article container structure at which the hinge structure 366 was located, and subsequently, the article container 354 can be pivotally moved around the axis effectively formed by means of such straps or tie members to the hook, loop, or eye fasteners disposed upon the side edge portion of the combination pallet and article container structure at which the hinge structure 366 was previously located.

Thus, it may be seen that in accordance with the principles and teachings of the present invention, there has been provided a new and improved combination pallet structure and article container which comprises a base panel, and a pair of laterally or transversely spaced, longitudinally extending pockets, or a pair of longitudinally spaced strap members, secured upon undersurface portions of the base panel so as to accommodate a pair of laterally or transversely spaced, longitudinally extending rigid support members. The pair of transversely or laterally spaced, longitudinally extending rigid support members are adapted to accommodate or house the fork tines of a forklift truck when the combination pallet structure and article container are to be lifted and transported. In addition, a pair of semi-rigid cross-brace members are respectively pivotally secured at first end portions thereof upon the pallet structure so as to be movable between first operative and second inoperative positions. When the pair of semi-rigid cross-brace members are disposed at their first operative, erected or assembled positions, the pair of semi-rigid cross-brace members will have their second opposite end portions thereof fixedly secured within addittional pocket members formed upon the pallet structure whereby the pair of semi-rigid cross-brace members will extend in laterally or transversely oriented positions so as to thereby provide lateral or transverse support to the pallet structure as a result of extending between the laterally or transversely spaced, longitudinally extending rigid support members.

Conversely, when the pair of semi-rigid cross-brace members are disposed at their second inoperative, knocked-down or disassembled positions, the second opposite end portions of the pair of semi-rigid cross-brace members will have been removed from the pocket members whereby the pair of semi-rigid cross-brace members will now be disposed in laterally or transversely spaced, longitudinally extending modes so as to be able to be disposed parallel to and atop the laterally or transversely spaced, longitudinally extending rigid support members in order to permit the entire pallet structure to be rolled up or folded for compact storage and transportation purposes. Still further, an article container is selectively or alternatively fixedly or removably secured atop the base panel so as to be pivotally movable between a position atop the pallet structure, or to a position disposed toward the side of the pallet structure whereby access to the top of the base panel is provided in order to move the pair of semi-rigid cross-brace members to their engaged or disengaged positions in order to assemble or erect, or to knock-down or disassemble, the pallet structure.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A combination knockdown pallet structure and article container for facilitating the lifting and transportation of articles by means of a forklift vehicle, comprising:

a knockdown pallet structure comprising a base panel having an upper surface portion, when said knockdown pallet structure is disposed in its normal operative orientation for use as a pallet structure, and an undersurface portion, when said knockdown pallet structure is disposed in said normal operative orientation for use as a pallet structure; a pair of transversely spaced, longitudinally extending rigid support members for accommodating the fork tines of a forklift vehicle; means for securing said pair of transversely spaced, longitudinally extending rigid support members upon said undersurface portion of said base panel; said base panel defining a first plane when effectively erected from a first knocked-down state to a second erected state; at least one elongated cross-brace member having a first end portion thereof attached to said upper surface portion of said base panel at a first predetermined location of said upper surface portion of said base panel; attachment means, fixedly mounted upon said upper surface portion of said base panel at a second predetermined location disposed transversely across from said first predetermined location at which said first end portion of said least one cross-brace member is attached to said upper surface portion of said base panel, for fixedly securing a second end portion of said at least one elongated cross-brace member; and means for pivotally attaching said first end portion of said at least one elongated cross-brace member to said upper surface portion of said base panel at said first predetermined location for movement within a second plane parallel to said first plane of said base panel when said base panel is disposed within said second erected state such that said at least one elongated cross-brace member is pivotally movable with respect to said upper surface portion of said base panel between a first operative, erected position at which said first end portion of said at least one cross-brace member is pivotally attached at said first end portion thereof to said first predetermined location of said upper surface portion of said base panel while said second end portion of said at least one elongated cross-brace member is fixedly attached to said attachment means fixedly mounted upon said upper surface portion of said base panel at said second predetermined location transversely across from said first predetermined location at which said at least one elongated cross-brace member is attached at said first end portion thereof to said upper surface portion of said base panel such that said at least one elongated cross-brace member is disposed transversely with respect to said pair of transversely spaced, longitudinally extending rigid support members so as to operatively interconnect said pair of transversely spaced, longitudinally extending rigid support members together, and a second inoperative, knockdown position at which said at least one elongated cross-brace member is disposed atop said base panel so as to be oriented parallel to said pair of transversely spaced, longitudinally extending rigid support members so as to be operatively disconnected from said pair of transversely spaced, longitudinally extending rigid support members and thereby permit said knock-down pallet structure to attain said knocked-down state;

an article container adapted to be disposed atop said knockdown pallet structure when said combination knockdown pallet structure and said article container are disposed in said erected state;

first fastener means, defined upon first side edge portions of said article container and said base panel of said knockdown pallet structure, for defining a pivotal locus about which said article container may be pivotally mounted upon said base panel of said knockdown pallet structure between a first knocked-down state and a second erected state with respect to said first knocked-down and second erected states of said knockdown pallet structure; and second fastener means, defined upon second opposite side edge portions of said article container and said base panel of said knockdown pallet structure, for releasably securing said second opposite side edge portion of said article container to said second side edge portion of said base panel of said knockdown pallet structure such that when said second fastener means, defined upon said second opposite side edge portion of said article container is released from said second fastener means, defined upon said second opposite side edge portion of said base panel of said knockdown pallet structure, said article container can be pivotally moved with respect to said base panel of said knockdown pallet structure so as to be disposed at its first knocked-down state at which said at least one elongated cross-brace member will be uncovered so as to be capable of movement between said first operative, erected position at which said first end portion of said at least one cross-brace member is pivotally attached at said first end portion thereof to said first predetermined location of said upper surface portion of said base panel while said second end portion of said at least one elongated cross-brace member is fixedly attached to said attachment means fixedly mounted upon said upper surface portion of said base panel at said second predetermined location transversely across from said first predetermined location at which said at least one elongated cross-brace member is attached at said first end portion thereof to said upper surface portion of said base panel such that said at least one elongated cross-brace member is disposed transversely with respect to said pair of transversely spaced, longitudinally extending rigid support members so as to operatively interconnect said pair of transversely spaced, longitudinally extending rigid support members together, and said second inoperative, knock-down position at which said at least one elongated cross-brace member is disposed atop said base panel so as to be oriented parallel to said pair of transversely spaced, longitudinally extending rigid support members so as to be operatively disconnected from said pair of transversely spaced, longitudinally extending rigid support members and thereby permit said knockdown pallet structure to attain a knocked-down compact state, whereas when said second fastener means, defined upon said second opposite side edge portion of said article container is secured to said second fastener means, defined upon said second opposite side edge portion of said base panel of said knockdown pallet structure, said article container can be pivotally moved with respect to said base panel of said knockdown pallet structure so as to be disposed at said second erected state wherein said article container will be disposed atop said base panel of said knockdown pallet structure and will cover said at least one elongated cross-brace member which is disposed transversely across said base panel of said knockdown pallet structure so as to be disposed at said first operative, erected position at which said at least one elongated cross-brace member operatively interconnects said pair of transversely spaced, longitudinally extending rigid support members together.

2. The combination as set forth in claim 1, wherein:

said first side edge portion of said article container is fixedly secured to said first side edge portion of said base panel of said knockdown pallet structure by said first fastener means.

3. The combination as set forth in claim 2, wherein:

said first fastener means for fixedly securing said side edge portion of said article container to said side edge portion of said base panel of said knockdown pallet structure comprises a living hinge structure.

4. The combination as set forth in claim 3, wherein:

said living hinge structure is formed by means selected from the group comprising sewn or stitching structures formed upon said first side edge portions of said article container and said base panel of said knockdown pallet structure.

5. The combination as set forth in claim 1, wherein:

said first and second fastener means, defined upon said first and second opposite side edge portions of said article container and said base panel of said knockdown pallet structure, are selected from the group comprising hook, eye, strap, tie, or loop structures.

6. The combination as set forth in claim 5, wherein:

said first and second fastener means, defined upon said first and second opposite side edge portions of said article container and said base panel of said knockdown pallet structure, are disposed within corner regions of said article container and said base panel of said knockdown pallet structure.

7. The combination as set forth in claim 1, wherein:

said article container comprises pleated end and bottom wall members for permitting said article container to be erected and knocked down.

8. The combination as set forth in claim 1, wherein:

said article container has a substantially rectangular parallelepiped configuration when disposed in its erected state.

9. The combination as set forth in claim 1, wherein:

said base panel and said article container comprise woven fabrics.

10. The combination as set forth in claim 1, wherein:

said pair of transversely spaced, longitudinally extending rigid support members comprise tubular pipe members.

11. The combination as set forth in claim 10, wherein:

each one of said pair of transversely spaced, longitudinally extending tubular pipe members has a semi-circular cross-sectional configuration.

12. The combination as set forth in claim 1, wherein:

said attachment means fixedly mounted upon said upper surface portion of said base panel comprises pocket means fixedly mounted upon said base panel for fixedly securing said second end portion of said at least one elongated cross-brace member at said first operative, erected position.

13. The combination as set forth in claim 1, wherein:

said at least one cross-brace member comprises a pair of cross-brace members which are movably mounted upon said base panel so as to be disposed within a longitudinally spaced, transversely extending array when said pair of cross-brace members are disposed at said first operative, erected positions, and are disposed within a transversely spaced, longitudinally extending array when said pair of cross-brace members are disposed at said second inoperative, knocked-down positions.

14. The combination as set forth in claim 13, wherein:

said pair of cross-brace members are pivotally mounted upon said base panel between said first operative, erected position and said second inoperative, knocked-down position.

15. The combination as set forth in claim 14, wherein:

said attachment means fixedly mounted upon said upper surface portion of said base panel comprises pocket means for fixedly securing said pair of cross-brace members at said first operative, erected positions.

16. The combination as set forth in claim 1, wherein said means for securing said pair of transversely spaced, longitudinally extending rigid support members upon said undersurface portions of said base panel comprise:

a pair of transversely spaced, longitudinally extending pocket structures.

17. The combination as set forth in claim 1, wherein said means for securing each one of said pair of transversely spaced, longitudinally extending rigid support members upon said undersurface portions of said base panel comprise:

a pair of longitudinally spaced straps.

18. The combination as set forth in claim 1, further comprising:

a third longitudinally extending rigid support member interposed between said pair of transversely spaced, longitudinally extending rigid support members for imparting additional support to said pallet structure.

19. The combination as set forth in claim 11, further comprising:

a pocket disposed atop said base panel; and an auxiliary support panel disposed within said pocket so as to provide said pallet structure with additional support.

20. A combination knockdown pallet structure and article container for facilitating the lifting and transportation of articles by means of a forklift vehicle, comprising:

a knockdown pallet structure comprising a base panel having an upper surface portion, when said knockdown pallet structure is disposed in its normal operative orientation for use as a pallet structure, and an undersurface portion, when said knockdown pallet structure is disposed in said normal operative orientation for use as a pallet structure; a pair of transversely spaced, longitudinally extending rigid support members for accommodating the fork tines of a forklift vehicle; means for securing said pair of transversely spaced, longitudinally extending rigid support members upon said undersurface portion of said base panel; said base panel defining a first plane when effectively erected from a first knocked-down state to a second erected state; at least one elongated cross-brace member having a first end portion thereof attached to said upper surface portion of said base panel at a first predetermined location of said upper surface portion of said base panel; attachment means, fixedly mounted upon said upper surface portion of said base panel at a second predetermined location disposed transversely across from said first predetermined location at which said first end portion of said least one cross-brace member is attached to said upper surface portion of said base panel, for fixedly securing a second end portion of said at least one elongated cross-brace member; and means for pivotally attaching said first end portion of said at least one elongated cross-brace member to said upper surface portion of said base panel at said first predetermined location for movement within a second plane parallel to said first plane of said base panel when said base panel is disposed within said second erected state such that said at least one elongated cross-brace member is pivotally movable with respect to said upper surface portion of said base panel between a first operative, erected position at which said first end portion of said at least one cross-brace member is pivotally attached at said first end portion thereof to said first predetermined location of said upper surface portion of said base panel while said second end portion of said at least one elongated cross-brace member is fixedly attached to said attachment means fixedly mounted upon said upper surface portion of said base panel at said second predetermined location transversely across from said first predetermined location at which said at least one elongated cross-brace member is attached at said first end portion thereof to said upper surface portion of said base panel such that said at least one elongated cross-brace member is disposed transversely with respect to said pair of transversely spaced, longitudinally extending rigid support members so as to operatively interconnect said pair of transversely spaced, longitudinally extending rigid support members together, and a second inoperative, knockdown position at which said at least one elongated cross-brace member is disposed atop said base panel so as to be oriented parallel to said pair of transversely spaced, longitudinally extending rigid support members so as to be operatively disconnected from said pair of transversely spaced, longitudinally extending rigid support members and thereby permit said knock-down pallet structure to attain a knocked-down compact state;

an article container; and first and second fastener means, respectively defined upon first and second opposite side edge portions of said article container and said base panel of said knock-down pallet structure, for permitting said article container to be removably mounted upon said base panel of said knockdown pallet structure between a first knocked-down state and a second erected state with respect to said base panel of said knock-down pallet structure such that when said first fastener means, defined upon said first and second opposite side edge portions of said article container, are released from said second fastener means, defined upon said first and second opposite side edge portions of said base panel of said knock-down pallet structure, said article container can be removed from said base panel of said knockdown pallet structure so as uncover said at least one elongated cross-brace member so as to enable said at least one elongated cross-brace member to be moved between said first operative, erected position at which said first end portion of said at least one cross-brace member is pivotally attached at said first end portion thereof to said first predetermined location of said upper surface portion of said base panel while said second end portion of said at least one elongated cross-brace member is fixedly attached to said attachment means fixedly mounted upon said upper surface portion of said base panel at said second predetermined location transversely across from said first predetermined location at which said at least one elongated cross-brace member is attached at said first end portion thereof to said upper surface portion of said base panel such that said at least one elongated cross-brace member is disposed transversely with respect to said pair of transversely spaced, longitudinally extending rigid support members so as to operatively interconnect said pair of transversely spaced, longitudinally extending rigid support members together in order to effectively dispose said knockdown pallet structure in its erected state, and said second inoperative, knockdown position at which said at least one elongated cross-brace member is disposed atop said base panel so as to be oriented parallel to said pair of transversely spaced, longitudinally extending rigid support members so as to be operatively disconnected from said pair of transversely spaced, longitudinally extending rigid support members and thereby permit said knockdown pallet structure to attain its knocked-down compact state, whereas when said first fastener means, defined upon said first and second opposite side edge portion of said article container are secured to said first and second fastener means, defined upon said first and second opposite side edge portions of said base panel of said knockdown pallet structure, said article container can be secured to said base panel of said knockdown pallet structure so as to be disposed at its second erected state at which said article container will be disposed atop said base panel of said knockdown pallet structure and will cover said at least one elongated cross-brace member which is disposed transversely across said base panel of said knockdown pallet structure so as to be disposed at said first operative, erected position at which said at least one elongated cross-brace member operatively interconnects said pair of transversely spaced, longitudinally extending rigid support members together.

21. The combination as set forth in claim 20, wherein:

said first and second fastener means, defined upon said first and second opposite side edge portions of said article container and said base panel of said knockdown pallet structure, are selected from the group comprising hook, eye, strap, tie, or loop structures.

22. The combination as set forth in claim 21, wherein:

said first and second fastener means, defined upon said first and second opposite side edge portions of said article container and said base panel of said knockdown pallet structure, are disposed within corner regions of said article container and said base panel of said knockdown pallet structure.

* * * * *